US007100669B1

(12) United States Patent
Donahue et al.

(10) Patent No.: US 7,100,669 B1
(45) **Date of Patent: *Sep. 5, 2006**

(54) ALUMINUM-SILICON CASTING ALLOY HAVING REFINED PRIMARY SILICON DUE TO PRESSURE

(75) Inventors: Raymond J. Donahue, Fond du Lac, WI (US); Terrance M. Cleary, Fond du Lac, WI (US)

(73) Assignee: Brunswick Corporation, Fond du Lac, WI (US)

( * ) Notice: Subject to any disclaimer, the term of this patent is extended or adjusted under 35 U.S.C. 154(b) by 29 days.

This patent is subject to a terminal disclaimer.

(21) Appl. No.: 10/409,798

(22) Filed: Apr. 9, 2003

(51) Int. Cl.
*B22C 9/04* (2006.01)
*B22D 27/13* (2006.01)

(52) U.S. Cl. ..... 164/34; 164/120

(58) Field of Classification Search ..... 164/34, 164/120, 235, 246
See application file for complete search history.

(56) References Cited

U.S. PATENT DOCUMENTS 3,753,690 A * 8/1973 Emley et al. ..... 75/412
4,139,045 A * 2/1979 Vitt ..... 164/34
4,969,428 A 11/1990 Donahue et al. ..... 123/195
5,014,764 A * 5/1991 Garat ..... 164/34
5,058,653 A * 10/1991 Garat ..... 164/34
5,088,544 A 2/1992 Garat ..... 164/34
5,161,595 A 11/1992 Garat ..... 164/34
5,355,930 A * 10/1994 Donahue et al. ..... 164/34
6,024,157 A * 2/2000 Donahue et al. ..... 164/34
6,200,396 B1 * 3/2001 Laslaz et al. ..... 148/437
6,322,729 B1 * 11/2001 Rexford et al. ..... 264/28
6,763,876 B1 * 7/2004 Donahue et al. ..... 164/34
6,883,580 B1 * 4/2005 Donahue et al. ..... 164/34

* cited by examiner

*Primary Examiner*—Kuang Y. Lin
(74) *Attorney, Agent, or Firm*—Andrus, Sceales, Starke & Sawall, LLP

(57) ABSTRACT

Provided herein is a method for refining primary silicon present in a hypereutectic aluminum silicon alloy. The method contemplates the controlled application of pressure to refine the primary silicon during the casting of articles. The application of pressure decreases the primary silicon particle size to improve the machinability and wear resistance of the final cast articles.

19 Claims, 1 Drawing Sheet

ALUMINUM-SILICON CASTING ALLOY HAVING REFINED PRIMARY SILICON DUE TO PRESSURE

BACKGROUND AND SUMMARY OF THE INVENTION

Internal combustion engines are increasingly being constructed from aluminum silicon alloys. Much research and development has been focused on the casting of such engine blocks and particularly on the silicon content of the alloys used to form such engine blocks. Lost foam and sand cast hypereutectic aluminum silicon alloy engine blocks are not used to a great extent in the automotive industry because such alloys are difficult to machine due to a presence of large primary silicon particles in the alloy microstructure. This invention describes an unexpected result with the application of pressure during the solidification of lost foam casting that decreases the primary silicon particle size and improves the machinability and wear resistance of such alloys.

In general, as aluminum cools from its liquid state, it reduces in volume. Silicon, however, expands as it cools. The laws of thermodynamics predict how the melting point of a metal changes with the application of pressure. The application of pressure to liquid aluminum, as with most metals, raises the melting point of aluminum. Again, silicon is the opposite, as the application of pressure serves to lower its melting point.

Hypereutectic aluminum silicon alloys (i.e., those alloys having greater than 11.6% silicon by weight) are conventionally used in the casting of engine blocks. Simple thermodynamic calculations indicate that the melting point of a 20% hypereutectic aluminum silicon alloy under 10 atmospheres of pressure will increase less than 1/20th of a degree. Thus, based on thermodynamic calculations, 10 atmospheres of pressure should not have an influence on the undercooling and nucleation of the silicon phase. In fact, no one has ever reported that pressure has an influence on grain size in single phase metals or in hypoeutectic aluminum silicon alloys (i.e., those alloys having less than 11.6% silicon by weight) which contain a large fraction of eutectic silicon.

Both eutectic modification and/or rapid freezing are known to increase the eutectic composition to higher silicon concentrations (e.g., from 12.6% to 15%) while simultaneously decreasing the eutectic temperature. Thus, alloys up to 15% silicon can be hypereutectic under conditions of slow cooling and no modification treatment and hypoeutectic under conditions of fast cooling or if treated with a modifier such as strontium or sodium. None of these changes are expected to be exacerbated with the application of 10 atmospheres of pressure because the melting point of the alloy is only changed by 1/20th of a degree Celsius with the application of 10 atmospheres of pressure.

With hypereutectic aluminum silicon alloys, melting point changes are expected to be even smaller than with aluminum or with silicon or with any of the hypoeutectic aluminum silicon alloys. Mondolfo, in *Aluminum Alloys*, reports that at 25% silicon, the volume change during a solid to liquid phase change is approximately zero. Also, since hypereutectic aluminum silicon alloys require phosphorus for the refinement of the primary silicon phase, the eutectic silicon phase is never modified and therefore the eutectic silicon phase is always coarse.

Further, each aluminum grain in the hypoeutectic aluminum silicon alloy microstructure is composed of a subset of aluminum dendrites which originate from the same nucleus.

The dendrite arm spacing (DAS) is determined by the cooling rate during solidification, with faster cooling resulting in smaller values of DAS. Between the dendrite arms is the eutectic and the eutectic silicon phase is refined, if it is treated with a modifier such as strontium, or is coarse, if not treated with a modifier.

Garat, Guy & Thomas in a 1991 AFS Congress paper entitled "Solidification Under Isostatic Pressure in the Lost Foam Process" reported the DAS for both Aluminum Association Alloy Nos. 356 and 319 with and without the application of 10 atmospheres of pressure. For each group, the authors reported a DAS of 55 microns for a local solidification time of approximately 125 seconds, which would indicate that the application of pressure has no effect on the dendritic arm spacing. The authors further reported a DAS of 23 microns for a permanent mold casting having a local solidification time of 20 seconds and a DAS of 48 microns for a sand casting having a local solidification time of 100 seconds. As with grain size, there is no indication that the eutectic silicon phase or morphology is influenced by the application of pressure.

Further, the primary silicon particle size should exhibit an inverse relationship with the number of silicon nuclei present in the liquid alloy that are active during the solidification process. The time it takes to escalate the isostatic pressure enters into the process of primary silicon nucleation because it is believed that at least some nuclei require a certain time in the liquid phase before pressure assisted "good wetting" can occur and the nuclei can become active.

Thus, it appears that none of the features of hypoeutectic aluminum silicon alloy microstructure, i.e., grain size, aluminum DAS or eutectic silicon morphology, is influenced by the application of pressure either theoretically (i.e., by thermodynamic calculations) or practically (i.e., by test results in the literature).

Surprisingly, it has been recognized that the application of pressure during the solidification of a hypereutectic aluminum silicon alloy casting decreases the primary silicon particle size. Specifically, in hypereutectic aluminum silicon alloys with silicon in the range of 16% to 28% and copper in the range of 0.05% to 4.5%, a smaller primary silicon particle size has been observed when pressure is used, than when pressure is not used. The unexpected decrease in primary silicon particle size improves the machinability and wear resistance of such alloys.

The current invention improves the solidification of a hypereutectic aluminum silicon alloy casting by applying an isostatic pressure to the casting before the solidified fraction of the alloy exceeds 25% by weight. Significantly, the aluminum silicon alloy contains additives of phosphorus in the range of 0.005% to 0.1% by weight. The phosphorus reacts with the liquid aluminum in the alloy to form aluminum phosphide, a heterogeneous nucleate for primary silicon. The application of the isostatic pressure promotes more effective and extensive nucleation of the primary silicon by lowering interfacial energy and creating more favorable nucleation conditions.

With the appropriate isostatic pressure application, the method of the invention achieves a finer primary silicon particle size for hypereutectic aluminum silicon alloy compositions in the silicon range of 16 to 28% and copper in the range of 0.05 to 4.9% with magnesium in the range of 0.3 to 1.3%, and phosphorus in the range of 0.005% to 0.1%. It must be appreciated that as the silicon composition of hypereutectic aluminum silicon alloys increases, the primary silicon particles have a natural tendency to increase in size. Thus, higher amounts of phosphorus are needed and more effective nucleation is required with higher silicon concentrations in the above range. It must also be recognized that a high copper content impacts primary silicon particle size as a high copper concentration creates a larger solidification range, which in turn, creates opportunity for primary silicon floatation resulting in avoidance of nucleation and creation of large silicon structures. Further, the molten alloy may be degassed with nitrogen prior to casting. The degassing with nitrogen provides a low hydrogen content in the melt, but tends to eliminate primary silicon nuclei because all nuclei are floated out of the melt by attachment to the rising nitrogen bubbles, The application of isostatic pressure is critically important. Higher pressures are more favorable. However, high pressures are also associated with higher manufacturing costs. Ten atmospheres has been found to be the most efficient pressure as isostatic pressures less than 5 atmospheres do not appear to be effective and isostatic pressures of 20 atmospheres appear to yield results similar to those attained with 10 atmospheres.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
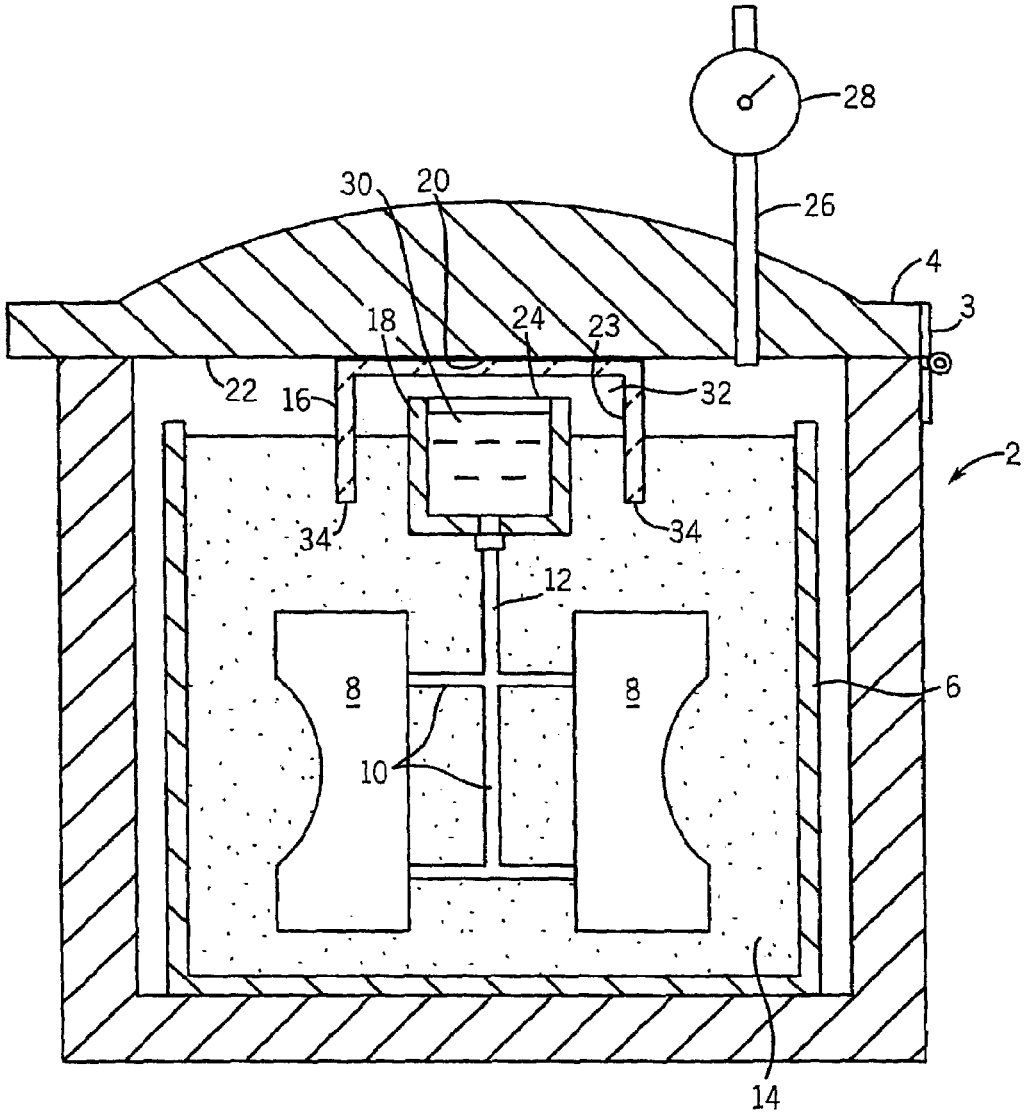
FIG. 1 is a vertical section of an apparatus that can be used to carry out the method of the invention.

The present invention discloses a method for producing a hypereutectic aluminum silicon alloy casting, such as an engine block, having refined primary silicon. FIG. 1 demonstrates a casting flask that may be utilized in the current lost foam casting method of the invention. Alternatively, other casting methods, such as conventional sand casting or investment casting, which incorporate the use of pressure may be used in accordance with the current invention.

With reference to FIG. 1, the method of the current invention contemplates preparing a casting flask 6, the casting flask having a pouring cup 18 to receive a molten metal 30. The pouring cup 18 is attached to a sprue 12 and further to a gating system 10. The gating system, in turn, is connected to a polymeric foam pattern 8 corresponding in configuration to the article to be cast.

The pouring cup 18, sprue 12, gating system 10, and pattern 8 are placed within a flask 6. The flask 6 is subsequently filled with unbonded sand 14, or a similar inert material. The sand 14, or similar inert material, surrounds the pattern 8, gating system 10, and partially encapsulates the pouring cup 18. The sand 14, or other inert material, also fills any voids or cavities that may be present in the pattern 8.

The flask 6 is then placed into an outer pressure vessel 2. Preferably, the outer pressure vessel 2 has a sub-member 16 attached to the bottom surface 22 of a cover 4. The sub-member 16 controls the application of pressure to the molten metal 30. Alternatively, other methods of controlling the pressure application to the molten metal 30 may be used. The pressure may be monitored through a pressure conduit 26 which is attached to a pressure meter 28.

After the flask 6 is placed into the outer pressure vessel 2, molten hypereutectic aluminum silicon alloy is poured into the pouring cup 18. In the preferred embodiment, the molten hypereutectic aluminum silicon alloy is degassed with nitrogen prior to pouring. The outer pressure vessel 2 is then sealed. In the preferred embodiment, the outer pressure vessel 2 has a hinge 3 which allows for hinged movement of the lid 4 to seal off the vessel 2. In closing the lid 4, the sub-member 16 is arranged over the pouring cup 18 in such a manner that a space 32 remains between the sub-member 16 and the pouring cup 18. The lower edges 34 of the sub-member 16 are submerged into the sand 14 as the lid 4 is closed. Thus, pressure must travel through the sand 14 in order to reach the space 32 and subsequently the molten metal 30. In this manner, the sub-member 16 allows for an equalized pressure application to the molten metal 30 as it travels through the gating system 10 and ablates or decomposes the polymeric foam pattern 8.

In an alternative embodiment, the flask 6 can be eliminated and the pouring cup 18, sprue 12, gating system 10 and pattern 8 are placed directly into the outer pressure vessel 2, in which case the vessel 2 constitutes a flask. The outer pressure vessel 2 is subsequently filled with sand 14, or other similar inert material, as described above. The sub-member 16 controls the pressure applied to the molten metal 30 in the same manner as described above.

As soon as the outer pressure vessel is sealed, external pressure in the range of 5.0 to 15 atmospheres is applied at a rate greater than 1 atmosphere per 12 seconds. Preferably, the external pressure is applied to the molten hypereutectic aluminum silicon alloy before the solidified fraction of metal for the alloy exceeds 25% by weight. Alternatively, the external pressure may be applied before the pattern 8 is entirely ablated. The pressure is maintained on the molten hypereutectic aluminum silicon alloy throughout solidification to provide a final cast engine block.

Significantly, the hypereutectic aluminum silicon alloy consists of silicon in the range of 16 to 25% by weight, copper in the range of 0.05 to 4.9% by weight, magnesium in the range of 0.5 to 1.3% by weight, and phosphorus in the range of 0.005 to 0.1% by weight, and the balance aluminum. The alloy may also contain less than 0.3% manganese by weight, less than 0.1% zinc by weight and less than 0.2% titanium by weight. Preferably, the alloy is degassed with nitrogen, refined with the addition of phosphorus and cast at a temperature at or above 1600° F.

The following example of the preferred embodiment further explains the current invention:

A hypereutectic aluminum silicon alloy having a composition of 19.1% silicon, 0.18% copper, 0.65% magnesium, 0.25% manganese, 0.02% zinc and 0.11% titanium by weight was prepared. The alloy was degassed with nitrogen, refined with a 0.025% addition of phosphorus, and cast at 1500° F. Pressure of 10 atmospheres was applied 5 seconds after pouring was complete, with the ramp up to 10 atmospheres taking approximately 60 seconds to obtain an engine block casting.

A subsequent engine block casting was made without pressure, with the alloy composition and casting temperature exactly the same as that used for the casting made with pressure. The non-pressurized casting was poured within 5 minutes of the castings made with pressure, and also degassed with nitrogen and refined with phosphorous.

The experimentation yielded the following results where X represents the primary silicon particle sizes for the sample experiencing no applied isostatic pressure during solidification, and Y representing the primary silicon particle sizes for the samples solidified under isostatic pressure of 10 atmospheres. <X> represents the mean particle size of variable X, and <Y> represents the mean particle size of particles Y. Further, no interactions are present between the X and Y populations. Determining whether or not two respective populations have the same or different means from two given samples that have received different treatments is a very practical statistical problem that is necessary in the evaluation of a new process treatment.

The following experimental data was obtained:

| w/o Pressure X (microns) | w/Pressure Y (microns) | X − <X> | (X − <X>)$^2$ | Y − <Y> | (Y − <Y>)$^2$ |
|---|---|---|---|---|---|
| 52.5 | 29.4 | 20.3 | 412.1 | 3.4 | 11.6 |
| 33.3 | 19.5 | 1.1 | 1.2 | −6.5 | 42.3 |
| 39.3 | 25.5 | 7.1 | 50.4 | −0.5 | 0.3 |
| 34.5 | 19.5 | 2.3 | 5.3 | −6.5 | 42.3 |
| 41.6 | 41.3 | 9.4 | 88.4 | 15.5 | 240.3 |
| 34.7 | 19.5 | 2.5 | 6.3 | −6.5 | 42.3 |
| 25.1 | 38.1 | −7.1 | 50.4 | 12.0 | 144.0 |
| 23.3 | 21.0 | −8.9 | 79.2 | −5.0 | 25.0 |
| 20.7 | 39.0 | −11.5 | 132.3 | 13.0 | 169.0 |
| 33.5 | 25.2 | 1.3 | 1.7 | −0.8 | 0.6 |
| 37.5 | 18.0 | 5.3 | 28.1 | −8.0 | 64.0 |
| 47.2 | 19.5 | 15.0 | 225.0 | −6.5 | 42.3 |
| 33.3 | 25.5 | 1.1 | 1.2 | −0.5 | 0.3 |
| 25.5 | 35.9 | −6.7 | 44.9 | 9.9 | 98.0 |
| 26.3 | 28.1 | −5.9 | 34.8 | 2.1 | 4.4 |
| 19.2 | 42.3 | −13.0 | 169.0 | 16.3 | 265.7 |
| 49.7 | 42.2 | 17.5 | 306.3 | 16.2 | 262.4 |
| 30.0 | 19.5 | −2.2 | 4.8 | −6.5 | 42.3 |
| 33.0 | 18.0 | 0.8 | 0.6 | −8.0 | 64.0 |
| 42.0 | 26.6 | 9.8 | 96.0 | 0.6 | 0.4 |
| 33.3 | 24.5 | 1.1 | 1.2 | −1.5 | 2.3 |
| 23.6 | 29.0 | −8.6 | 74.0 | 3.0 | 9.0 |
| 25.5 | 36.3 | −6.7 | 44.9 | 10.3 | 106.1 |
| 37.5 | 18.0 | 5.3 | 28.1 | −8.0 | 64.0 |
| 34.5 | 18.0 | 2.3 | 5.3 | −8.0 | 64.0 |
| 26.0 | 30.8 | −6.2 | 38.4 | 4.8 | 23.0 |
| 33.0 | 24.5 | 0.8 | 0.6 | −1.5 | 2.3 |
| 28.5 | 30.0 | −3.7 | 13.7 | 4.0 | 16.0 |
| 23.6 | 25.5 | −8.6 | 74.0 | −0.5 | 0.3 |
| 33.3 | 19.7 | 1.1 | 1.2 | −6.3 | 39.7 |
| 22.2 | 18.0 | −10.0 | 100.0 | −8.0 | 64.0 |
| 25.1 | 18.0 | −7.1 | 50.4 | −8.0 | 64.0 |
| 27.8 | 33.3 | −4.4 | 19.4 | 7.3 | 53.3 |
| 33.0 | 19.5 | 0.8 | 0.6 | −6.5 | 42.3 |
| 20.7 | 19.5 | −11.5 | 132.3 | −6.5 | 42.3 |
| 38.9 | 19.5 | 6.7 | 44.9 | −6.5 | 42.3 |
| 28.8 | 18.0 | −3.4 | 11.6 | −8.0 | 64.0 |
| 45.0 | 25.5 | 12.8 | 163.8 | −0.5 | 0.3 |
| 28.8 | 25.5 | −3.4 | 11.6 | −0.5 | 0.3 |
| 31.2 | 28.1 | −1.0 | 1.0 | 2.1 | 4.4 |
| 38.3 | 18.0 | 6.1 | 37.20 | −8.0 | 64.0 |
| | 19.5 | | | −6.5 | 42.3 |
| | 21.0 | | | −5.0 | 25.0 |
| | 26.6 | | | 0.6 | 0.4 |
| | 36.3 | | | 10.3 | 106.1 |
| | 38.1 | | | 12.1 | 146.4 |
| | 33.5 | | | 7.5 | 56.3 |
| | 18.0 | | | −8.0 | 64.0 |
| | 19.5 | | | −6.5 | 42.3 |
| | 30.8 | | | 4.8 | 23.0 |
| | 22.5 | | | −3.5 | 12.3 |
| | 22.5 | | | −3.5 | 12.3 |
| | 30.8 | | | 4.8 | 23.0 |
| | 28.1 | | | 2.1 | 4.4 |
| | 27.0 | | | 1.0 | 1.0 |
| | 27.0 | | | 1.0 | 1.0 |
| <32.2> w/o P | <26.0> w/P | Σ + .6 | Σ 2 592.2 | Σ − 1.9 | Σ 2 267.4 |

If X and Y are designated as the variables of two normally and independently distributed populations, $N_1$ and $N_2$, having means $M_x$ and $M_y$, respectively, and identical standard deviations, then the $N_1X$ variables have a mean particle size of <X> and the $N_2Y$ variables have a mean particle size of <Y>.

The equation:

$$t = \frac{(<X> - <Y>) - (<M_x - M_y>)}{S_{x-y}}$$

satisfies a student's t distribution with $(N_1+N_2-2)$ degrees of freedom, where the best estimate of the standard deviations from the difference of the means of the $N_1X$ variables and the $N_2Y$ variables is denoted by $S_{x-y}$ and is equal to:

$$S=\sqrt{S_x^2+S_y^2}$$

As further explanation of these terms, when the standard deviations of the two populations are unknown, the assumption is made that the two populations have identical standard deviations, and this permits the use of the variants to arrive at a "pooled" estimate of the standard deviation. This "pooled" estimate of the standard deviation, S, is the square root of the ratio of total of the sums of the squares of the deviations of the variants of each sample from its mean divided by the total of the degrees of freedom of the two samples, and the standard deviation is not affected by any difference that may exist between the means of the populations. It is thus given by the following expression:

$$S=\sqrt{(\Sigma(X-<X>)^2+\Sigma(Y-<Y>)^2/(N_1+N_2-2)}$$

Also, since a population will contain more extreme data than a sample, the best estimate of the standard deviation of the means of the samples $N_1$ and $N_2$ variants, respectively, is denoted by $S_x$ and $S_y$ and is equal to: $S_x=S/\sqrt{N_1}$ and $S_y=S/\sqrt{N_2}$. Thus, it follows, since there are no interactions between the populations, that $S_{x-y}=\sqrt{S_x^2+S_y^2}$.

Applying the data obtained to the above referenced equations, the following results are obtained:

$$S=\sqrt{(\Sigma(X-<X>)^2+\Sigma(Y-<Y>)^2/(N_1+N_2-2)}$$

$$S = \sqrt{\frac{2592.2 + 2267.4}{41 + 56 - 2}} = \sqrt{\frac{4859.6}{95}} = \sqrt{51.15} = 7.15$$

$$S_x = \frac{S}{\sqrt{N_1}} = \frac{7.15}{\sqrt{41}} = \frac{7.15}{6.40} = 1.12$$

$$S_y = \frac{S}{\sqrt{N_2}} = \frac{7.15}{\sqrt{56}} = \frac{7.15}{7.80} = 0.956$$

$$S_{x-y}+S\sqrt{S_x^2+S_y^2}=\sqrt{(1.12)^2+(0.96)^2}=\sqrt{1.25+0.92}=\sqrt{2.17}=1.47$$

$$t = \frac{(32.2 - 26.0) - 0}{1.47} = 4.22$$

Therefore, because the absolute value of t equals 4.22, it must be concluded that the probability of selecting from two populations, populations with identical means and identical standard deviations, two samples whose means differ by more than 6.2 microns is considerably less than 5% (which, for df=95, $t_{0.05}$=1.99). In fact, the probability is less than 1% (which, for df=95, $t_{0.01}$=2.64), and even 0.1% (which, for df=95, $t_{0.001}$=3.42). Such comparative numbers indicate that this result is significant by any standard.

Thus, the difference between the primary silicon particle size means with and without the application of pressure is significant to warrant the conclusion that the method using pressure is substantially better than the one not using pressure.

Therefore, the current invention provides a hypereutectic aluminum silicon alloy having refined primary silicon due to the application of pressure. The silicon particle sizes are reduced by 15 to 25%. The more highly refined silicon particles help create an alloy that provides final cast articles with increased machinability and wear resistance.

We claim:

1. A method of casting a hypereutectic aluminum silicon alloy, comprising the steps of preparing a molten hypereutectic aluminum silicon alloy consisting essentially of: 16–28% by weight silicon, 0.90–4.9% by weight copper, 0.3–1.3% by weight magnesium, 0.005–0.1% by weight phosphorus, less than 0.3% by weight manganese, less than 0.2% by weight titanium and less than 0.1% by weight zinc; pouring said molten hypereutectic aluminum-silicon into a flask at a temperature at or greater than 1600° F., said flask containing a foam pattern having a configuration of an item to be cast; applying external pressure in the range of 5.5 to 50 ATM to the molten hypereutectic aluminum-silicon in the flask before the foam pattern is entirely ablated by the molten alloy; and maintaining the pressure on the molten hypereutectic aluminum-silicon through solidification to produce a cast article having a reduced average silicon particle size by 15 to 25%, compared to the average silicon particle size realized without applying and maintaining said external pressure.

2. The method of claim 1 including the step of utilizing a lost foam casting flask comprising a polymeric foam pattern having a configuration identical to the article to be cast and an unbonded, finely divided inert material surrounding said pattern.

3. The method of claim 1 including the step of utilizing a conventional sand casting flask.

4. The method of claim 1 including the step of utilizing an investment casting flask.

5. The method of claim 1 wherein, the step of applying external pressure comprises sealing of the flask in an external pressure vessel and applying external pressure to the molten hypereutectic aluminum-silicon before the solidified fraction of metal for the alloy exceeds 25% by weight by applying the external pressure immediately after the external pressure vessel is sealed.

6. The method of claim 1 wherein, the step of applying external pressure comprises sealing the flask in an external pressure vessel and applying external pressure to the molten hypereutectic aluminum-silicon alloy immediately after the external pressure vessel is sealed.

7. The method of claim 1 wherein, the step of applying external pressure comprises sealing the flask in an external pressure vessel and applying external pressure to the molten hypereutectic aluminum-silicon after the foam pattern is 50% ablated by applying the external pressure after a predetermined period of time after the external pressure vessel is sealed.

8. The method of claim 1, wherein, the molten hypereutectic aluminum-silicon alloy is degassed with nitrogen prior to pouring said alloy into said flask.

9. The method of claim 1 wherein, the step of applying external pressure further comprises applying pressure at a rate greater than 1 ATM per 12 seconds.

10. The method of claim 2 wherein, the step of utilizing a lost foam casting flask further comprises attaching a pouring cup to a pattern corresponding in configuration to an engine block.

11. A method for producing a hypereutectic aluminum-silicon alloy engine block having refined primary silicon, the method comprising: preparing a casting flask, placing the flask in a pressure vessel; pouring molten hypereutectic aluminum-silicon alloy consisting essentially of: 16–28% by weight silicon, 0.90–4.9% by weight copper, 0.3–1.3% by weight magnesium, 0.005–0.1% by weight phosphorus, less than 0.3% by weight manganese, less than 0.2% by weight titanium and less than 0.1% by weight zinc into the flask at a temperature at or greater than 1600° F., said flask containing a foam pattern having a configuration of an item to be cast; sealing the pressure vessel; applying external pressure in the range of 5.5 to 50 ATM to the molten hypereutectic aluminum-silicon before the foam pattern is entirely ablated by the molten alloy; and maintaining the pressure on the molten hypereutectic aluminum-silicon through solidification of the alloy provide a final cast engine block, wherein the final cast engine block has an average silicon particle size reduced by 15 to 25%, as compared to the average silicon particle size realized without applying and maintaining external pressure.

12. The method of claim 11 wherein, the step of preparing a casting flask further comprises preparing a lost foam casting flask.

13. The method of claim 11 wherein, the step of preparing a casting flask further comprises preparing a sand casting flask.

14. The method of claim 11 wherein, the step of applying external pressure comprises applying external pressure to the molten hypereutectic aluminum-silicon before the solidified fraction of metal for the alloy exceeds 25% by weight by applying the external pressure immediately after sealing the pressure vessel.

15. The method of claim 11 wherein, the step of applying external pressure comprises applying the external pressure immediately after sealing the pressure vessel.

16. The method of claim 11 wherein, the step of applying external pressure comprises applying external pressure to the molten hypereutectic aluminum-silicon before a lost foam pattern is 50% ablated by applying the external pressure after a predetermined period of time after sealing the pressure vessel.

17. The method of claim 11, further comprising the step of degassing with nitrogen the molten hypereutectic aluminum-silicon alloy prior to the step of pouring molten hypereutectic aluminum-silicon into the flask.

18. The method of claim 11 wherein, the step of applying external pressure further comprises applying pressure at a rate greater than 1 ATM per 12 seconds.

19. A method of casting a hypereutectic aluminum silicon alloy, comprising the steps of preparing a molten hypereutectic aluminum silicon alloy consisting essentially of: 16–28% by weight silicon, 0.90–4.9% by weight copper, 0.3–1.3% by weight magnesium, 0.005–0.1% by weight phosphorus, less than 0.3% by weight manganese, less than 0.2% by weight titanium and less than 0.1% by weight zinc; pouring said molten hypereutectic aluminum-silicon into a flask at a temperature at or greater than 1600° F., said flask containing a foam pattern having a configuration of an item to be cast; applying external pressure in the range of 5.5 to 50 ATM to the molten hypereutectic aluminum-silicon in the flask before the foam pattern is entirely ablated by the molten alloy; solidifying the alloy to produce a casting having primary silicon particles in the microstructure, and reducing the particle size of the primary silicon particles by applying an external pressure in the range of 5.5 to 50 ATM to the molten alloy before the solidified fraction of the alloy exceeds 25% by weight through application of the external pressure immediately after said molten hypereutectic aluminum-silicon is completely poured into the flask, and wherein the primary silicon particle size is reduced by 15–25% as compared to the average silicon particle size realized without applying and maintaining the external pressure.

* * * * *